United States Patent [19]

Naegelin

[11] 4,147,208

[45] Apr. 3, 1979

[54] HEAT EXCHANGER

[75] Inventor: Roland Naegelin, Winterthur, Switzerland

[73] Assignee: Sulzer Brothers Limited, Winterthur, Switzerland

[21] Appl. No.: 729,821

[22] Filed: Oct. 5, 1976

[30] Foreign Application Priority Data

Oct. 6, 1975 [CH] Switzerland ..... 12926/75

[51] Int. Cl.[2] ..... F28F 9/00

[52] U.S. Cl. ..... 165/159; 176/87; 122/32

[58] Field of Search ..... 165/158–162; 122/32, 34, 510; 176/60, 65

[56] References Cited

U.S. PATENT DOCUMENTS

| | | | |
|---|---|---|---|
| 3,748,228 | 7/1973 | Zimmerman | 176/60 |
| 3,854,528 | 12/1974 | Pouderoux | 122/32 |
| 4,025,387 | 5/1977 | Haferkamb | 176/60 |

FOREIGN PATENT DOCUMENTS

| | | | |
|---|---|---|---|
| 109926 | 10/1917 | United Kingdom | 165/158 |

*Primary Examiner*—Charles J. Myhre
*Assistant Examiner*—Theophil W. Streule, Jr.
*Attorney, Agent, or Firm*—Kenyon & Kenyon, Reilly, Carr & Chapin

[57] ABSTRACT

The heat exchanger which acts as a recuperator is constructed of a plurality of identical sub-assemblies which can be manufactured and tested in a plant and shipped as individual units to a construction site. Each sub-assembly includes a plurality of straight tubes which interconnect with spherical shells at each end and which serve to carry a flowable medium. Each sub-assembly also includes a guide tube about the straight tubes which is open at both ends to convey a flowable medium over the straight tubes but which has an outer flange which cooperates with similar flanges on the other sub-assemblies to block any flow of this medium over the outside surfaces of the guide tube from one end to the other.

7 Claims, 14 Drawing Figures

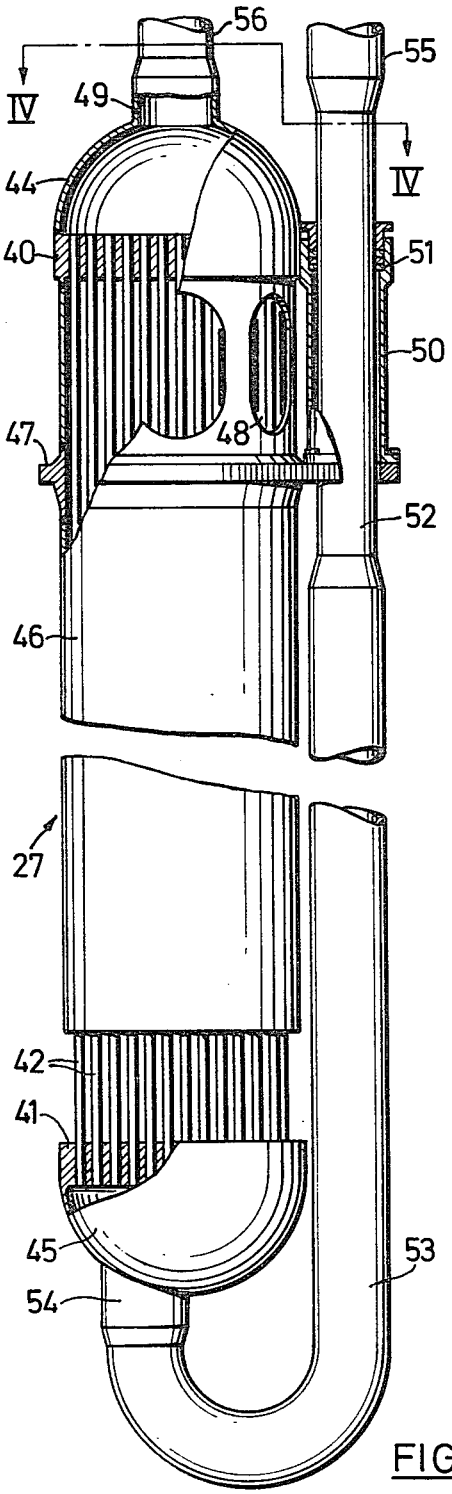
FIG. 3
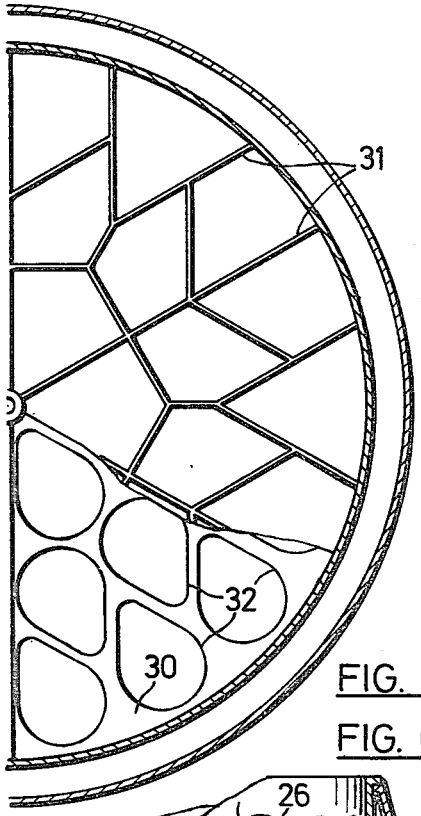
FIG. 5
FIG. 6
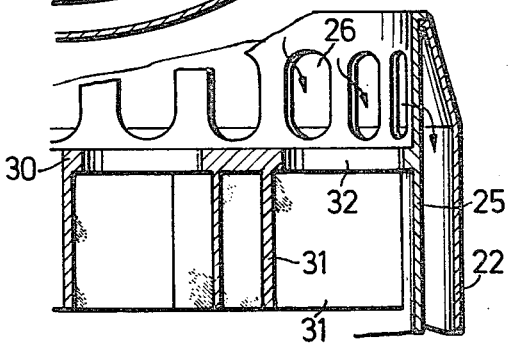
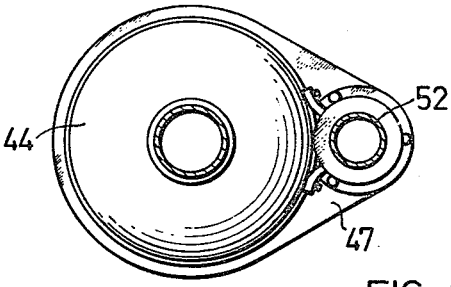
FIG. 4

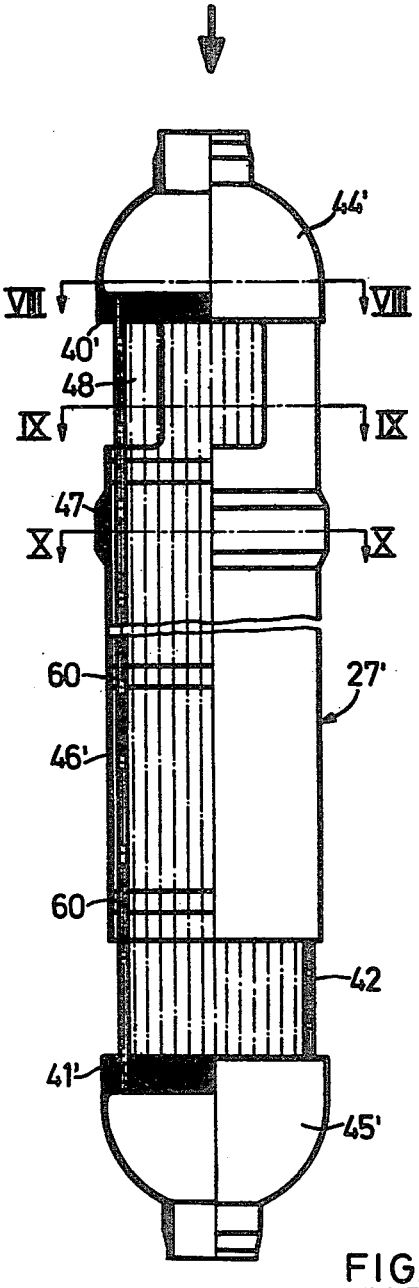
FIG. 7
FIG. 8
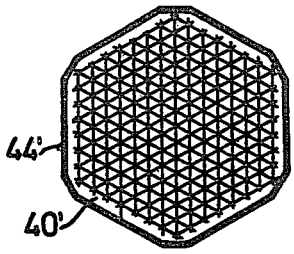
FIG. 9
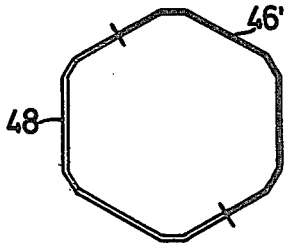
FIG. 10
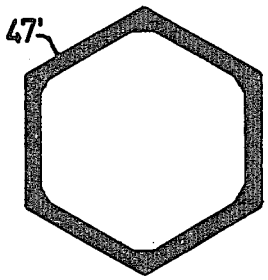

HEAT EXCHANGER

This invention relates to a heat exchanger and more particularly to a recuperator for a flow of gaseous media.

As is known, various types of heat exchangers have been known for placing two flows of media into heat exchange relation, for example for use as recuperators in gas-cooled high-temperature nuclear reactors. In some cases, these heat exchangers have been constructed of several identical sub-assemblies, each of which consists of straight tubes connected between tube sheets, spherical heads which extend over the tube sheets and lines which connect to the spherical heads. The connecting lines allow one of the two flowable media participating in the heat exchange to flow substantially lengthwise through the straight tubes. However, the sub-assemblies which have been used for these heat exchangers frequently require fabrication in the field and, as such, cannot be readily checked for leakage previous to shipment from a plant or shop.

Accordingly, it is an object of the invention to provide a sub-assembly for a heat exchanger which can be pre-fabricated.

It is another object of the invention to provide a sub-assembly for a heat exchanger which can be tested in a shop prior to shipment.

It is another object of the invention to construct a heat exchanger of pre-fabricated sub-assemblies in a simple economical manner.

Briefly, the invention provides a heat exchanger which is comprised of a plurality of sub-assemblies which can be pre-fabricated and subsequently assembled in the field. Each sub-assembly includes a plurality of straight tubes, a pair of tube sheets which mount the tubes therein with each tube sheet being disposed at a respective end of the straight tubes, a pair of spherical shells with each shell extending over a respective tube sheet, an inlet line connected to one of the shells to deliver a flowable medium into the shell for passage through the straight tubes, an outlet line connected to the other of the shells to exhaust the medium from the straight tubes and a guide tube which surrounds the straight tubes and has openings at opposite ends for conducting a flowable medium therethrough over the straight tubes. In addition, each sub-assembly has an outer flange on the guide tube intermediate the ends of the guide tube. The flanges of these sub-assemblies are disposed adjacent to each other to form a seal to prevent a flow of the flowable medium from passing about each guide tube between the ends.

Each guide tube is secured at one end to one of the shells of a respective sub-assembly and has the openings for the flowable media formed in the sidewalls while being spaced at the opposite end from the other shell of the sub-assembly to form the necessary opening for the flowable medium.

The sub-assemblies can be arranged in any suitable pattern and when placed in a vertical array may be supported by a common plate. In this case, the plate is provided with openings into which the sub-assemblies are inserted so as to be supported via the flanges. The outlet lines of each sub-assembly may pass through the flange in parallel relation to the guide tube or may connect to a common plenum which passes through the center of an array of the sub-assemblies.

The heat exchanger is distinguished by a simple and clear-cut construction which permits inexpensive fabrication. By subdividing the heat exchanger into individual sub-assemblies, it is possible to prefabricate the sub-assemblies in a shop and to subject the sub-assemblies to the usual tests, particularly for tightness while in the shop. The individual subassemblies are constructed with such dimensions that they can be transported to an installation site via the usual transport means by rail and/or highway. At the installation site, fast, secure and therefore, cost-saving assembly of the overall heat exchanger is made possible.

The heat exchanger has the additional advantage of allowing an advantageous utilization of the space in which the heat exchanger is accommodated so as to obtain an intensive and uniform heat exchange over the flow cross section. As a result, practically no strains develop.

The seal formed by the outer flanges of the sub-assemblies is not necessarily meant to be absolute, it is rather sufficient that the flow of the medium is throttled at the gaps between the outer flanges to such an extent that the flow is negligibly small.

These and other objects and advantages of the invention will become more apparent from the following detailed description and appended claims taken in conjunction with the accompanying drawings in which:

FIG. 3 illustrates a broken view of a sub-assembly of the heat exchanger in accordance with the invention;

FIG. 4 illustrates a top view of the sub-assembly according to FIG. 3;

FIG. 5 illustrates a horizontal cross-sectional view of the heat exchanger of FIG. 2 without sub-assemblies;

FIG. 6 illustrates a vertical cross-sectional view of the heat exchanger of FIG. 2 without sub-assemblies;

FIG. 7 illustrates a view, partially in cross section of another embodiment of a sub-assembly according to the invention;

FIG. 8 illustrates a view taken on line VIII—VIII of FIG. 7;

FIG. 9 illustrates a view taken on line IX—IX of FIG. 7;

FIG. 10 illustrates a view taken on line X—X of FIG. 7;

Figure 1:
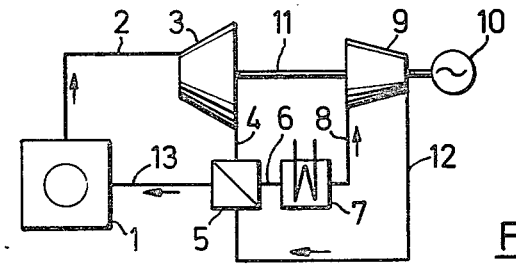
FIG. 1 illustrates a schematic view of a thermal power plant in which a heat exchanger according to the invention is used as a recuperator.

Referring to FIG. 1, a thermal power plant has a gas-cooled nuclear reactor 1 connected via a hot gas line 2 to a gas turbine 3, the discharge of which is connected via a line 4 to a recuperator 5. From the recuperator 5, the gas flows via a line 6 through a cooler 7 and a line 8 to a compressor 9 which, together with the gas turbine 3 and an electric generator 10, is mounted on a common shaft 11. The gas compressed in the compressor 9 then flows via a line 12 to the secondary side of the recuperator 5 and from there back to the nuclear reactor 1 via a line 13. The recuperator 5 is preferably housed in a concrete structure of the nuclear reactor 1, as is shown in detail in FIG. 2.

Figure 2:
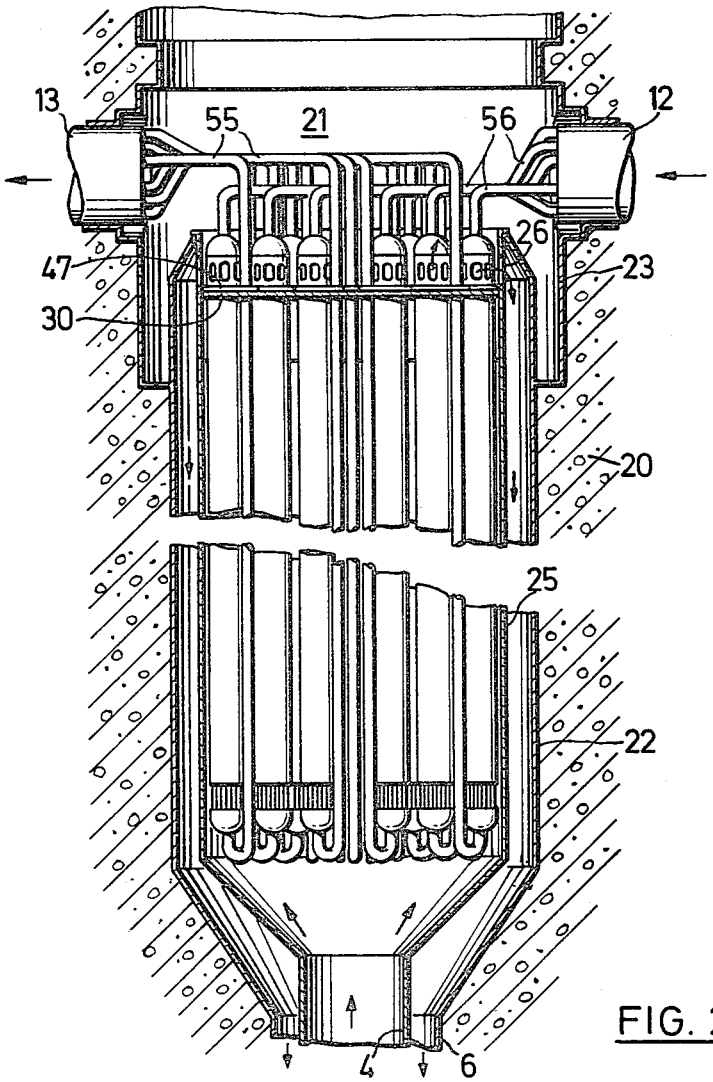
FIG. 2 illustrates a vertical cross section through the heat exchanger according to the invention.

Referring to FIG. 2, a concrete pressure vessel 20 of the nuclear reactor 1 includes a cavity 21 which is disposed on a vertical axis and which has a lower portion lined with a steel shell 22 and an upper portion lined with a steel lining 23. The steel shell 22 is tapered conically at the bottom and is connected to the line 6 while at the top, the steel shell 22 protrudes into the cavity 21. The upper end of the steel shell 22 is likewise tapered conically and is connected to a tubular wall 25 which is arranged concentrically with the shell 22. The wall 25 is conically tapered at the bottom and is connected to the line 4. In addition, the tubular wall 25 is provided with openings 26 in the vicinity of the upper end. A horizontal plate 30 is tightly connected to the wall 25 below these openings 26 and rests on a web structure 31 (FIG. 5) to which the plate 30 is fixedly joined by welding. The plate 30 has openings 32 of oval shape between the webs of the web structure 31. A heat exchanger subassembly 27 is mounted in each of these openings 32.

Referring to FIG. 3, each of the sub-assemblies 27 consists of an upper tube sheet 40 and a lower tube sheet 41 between which a large number of straight heat exchanger tubes 42 extend. A spherical head or shell 44, 45 extends over each of the tube sheets 40, 41. A guide tube 46 is welded to the upper tube sheet 40 and extends over the major part of the length of the heat exchanger tubes 42 in surrounding relation and terminates in spaced relation to the lower shell 45. The guide tube 46 has an outer flange 47 intermediate the ends as well as several passage openings 48 between the outer flange 47 and the upper tube sheet 40. As shown in FIG. 4, the outer flange 47 has an oval shape and supports a cylindrical sleeve 50 (FIG. 3) which is tightly connected to the flange 47. The sleeve 50 is located on an axis which is parallel to the vertical axis of the sub-assembly and is equipped with an expandable sealing means such as a stuffing gland 51. The flange 47 is drilled-out beside the guide tube 46 to the inside diameter of the sleeve 50. An outlet line in the form of a pipe section 52 is tightly connected via a U-shaped pipe 53 to a nozzle 54 fastened to the spherical head 45. This line 52 extends through the sleeve 50 and the stuffing gland 51.

Referring to FIG. 2, the outlet lines 52 of the subassemblies 27 are connected via connecting pipes 55 to a tube sheet (not shown) which is arranged in the vicinity of the steel lining 23 and to which the line 13 (FIG. 1) is connected. The line 12 is welded, likewise in the vicinity of the lining 23 to a tube sheet (not shown) from which connecting pipes which act as inlet lines 56 lead to and are tightly connected to nozzles 49 arranged on the heads 44 of the sub-assemblies 27.

During operation of the thermal power plant, gas, e.g. helium, which comes from the reactor 1 and is expanded in the gas turbine 3, flows as the primary medium via the line 4 into the space below the subassemblies 27. The gas then enters into the bundles formed by the tubes 42 of the individual sub-assemblies 27 through the openings formed between the lower end of the guide tube 46 and the tube sheet 41. Thereafter, the gas flows along the tubes 42 into the vicinity of the upper tube sheet 40 and exits into the cavity 21 lined with the lining 23 through the passage openings 48. From this cavity 21, the now cooled-down gas passes through the openings 26 into the annular space between the tubular wall 25 and the steel shell 22 and then flows out through the line 6. After being cooled further in the cooler 7 and being compressed in the compressor 9, the gas is delivered as a secondary medium into the shells 44 of the upper tube sheets 40 via the line 12 and the connecting lines 56. The gas then flows through the tubes 42 while absorbing heat and is thereupon collected in the shells 45 of the lower tube sheets 41. The preheated gas then is exhausted via the nozzles 54, the U-pipes 53, the pipe sections 52 and the connecting pipes 55 back to the nuclear reactor 1 via the lines 13.

Different thermal expansion of the tubes 42 and the U-pipe 53 causes relative displacements of the pipe sections 52 and the sleeve 50 which are taken up by the stuffing gland 51. The sleeve 50 and the stuffing gland 51 may also be replaced by expansion compensators in the form of bellows.

Figure 11:
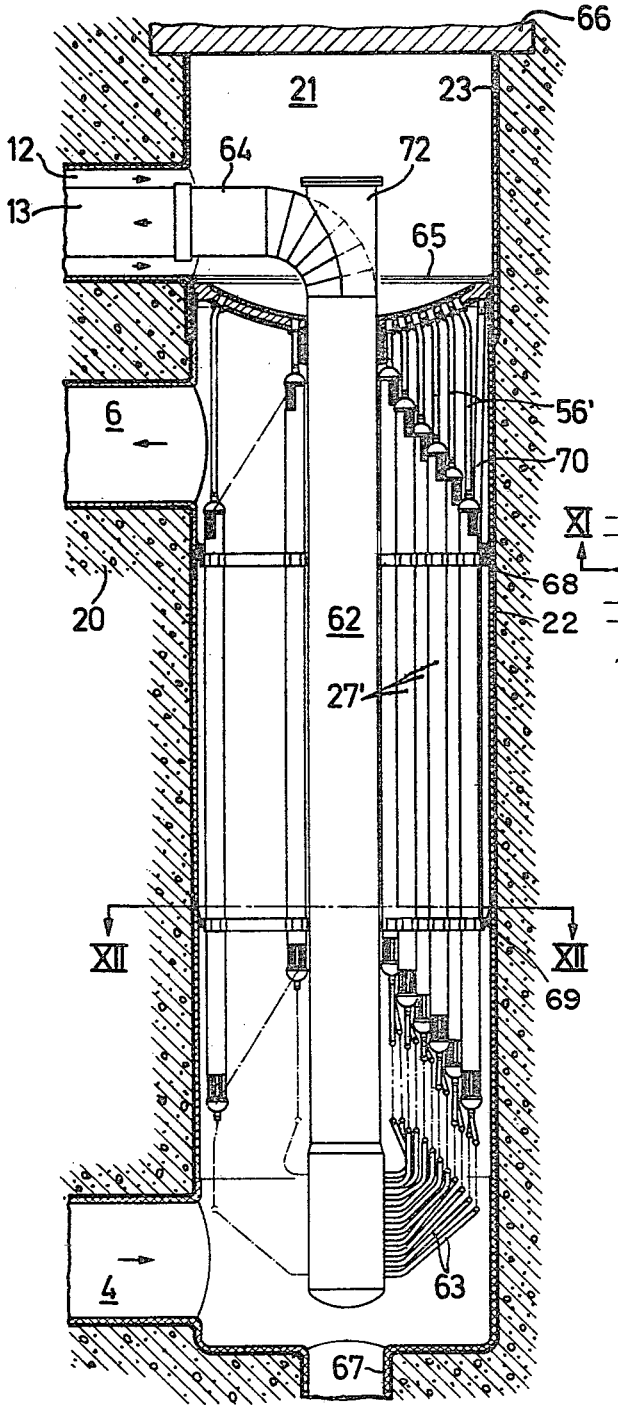
FIG. 11 illustrates a vertical cross-sectional view through a heat exchanger using sub-assemblies according to FIG. 7 as per line XI—XI of FIG. 12.

Referring to FIG. 11, the heat exchanger can also be fabricated of individual subassemblies 27′ which consist, as is shown in FIG. 7, of two tube sheets 40′ and 41′, between which straight heat exchanger tubes 42 extend and which are tightly connected to the tube sheets 40′, 41′. As shown in FIG. 8, the tubes 42 are uniformly distributed over a regular hexagon and the tube sheet 40′ while the rim of the shell 44′ connected thereto has a substantially hexagonal contour. The lower tube sheet 41′ and shell 45′ are of the same shape.

As shown in FIG. 9, the guide tube 46′ is of a contour corresponding to the contour of the bundle formed by the tubes 42 and a passage opening 48 extends over one-half the circumference of the guide tube 46′ near the upper end.

As shown in FIG. 10, the outer flange 47′ of the guide tube 46′ is in the form of a regular hexagon. In the assembled condition of the sub-assemblies 27′, the outer flanges 47′ lie closely together, so that practically only a negligibly small amount of gas can flow through the gaps between the outer flanges 47′. In order to keep the guide tube 46′ spaced from the tubes 42, suitable means 60, not specifically detailed here, are provided.

Figure 12:
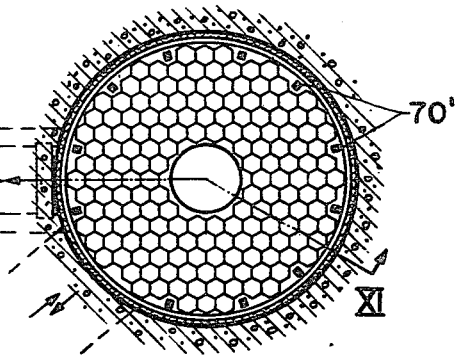
FIG. 12 illustrates a horizontal cross-sectional taken on line XIII—XIII of FIG. 11.

As shown in FIG. 11, the heat exchanger constructed from the sub-assemblies 27′ is arranged in a cavity 21 of a nuclear reactor vessel on a vertical axis in such a manner that the sub-assemblies 27′ are staggered in pyramid-fashion. A vertical plenum 62 is arranged at the center of the heat exchanger and is connected at the lower end to the lower connecting lines 63 of the subassemblies 27′. The plenum 62 is connected at the upper end to the line 13 via an elbow 64. The upper connecting lines 56′ of the sub-assemblies 27′ open into a downward dished tube sheet 65 and, at the same time, form the suspension for the sub-assemblies 27′. The tube sheet 65 is tightly connected to the steel liner 23 to which the line 12 is connected. As shown, the line 12 surrounds the line 13 with a larger diameter. As seen in FIG. 12, the lines 4 and 6 are arranged not axially to the heat exchanger but radially in the concrete structure 20. The cavity 21 can be closed off at the upper end by means of a cover 66 while a vertical canal 67 is provided at the lower end of the cavity 31 to serve for inspection purposes.

Figure 13:
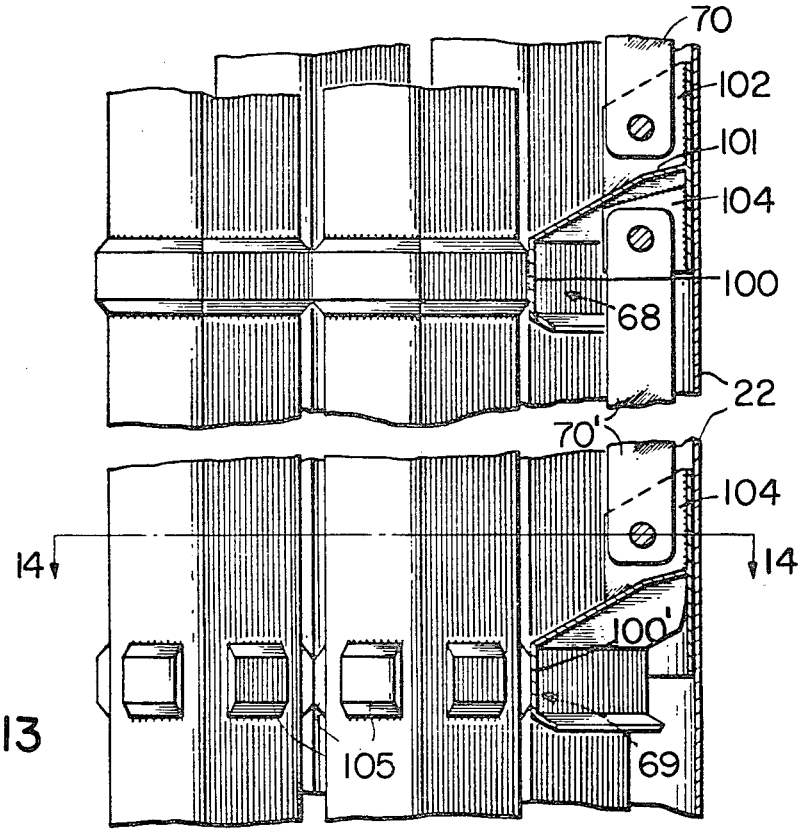
FIG. 13 illustrates a fragmentary view of the heat exchanger of FIG. 11 with a seal and brace employed therein in accordance with the invention.
Figure 14:
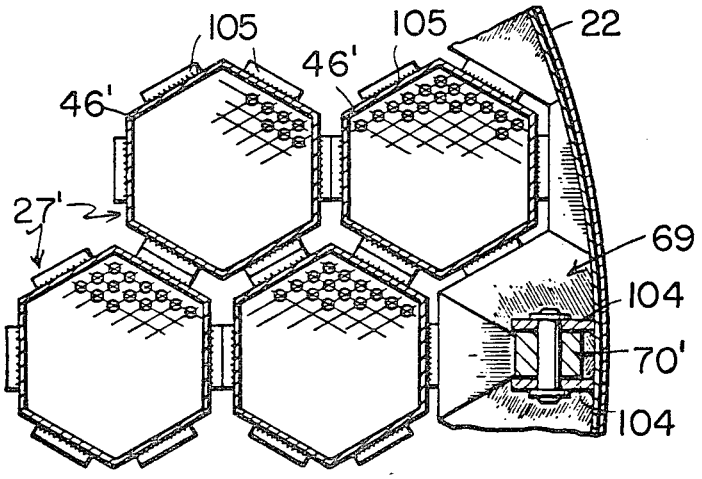
FIG. 14 illustrates a partial view taken on line XIV—XIV of FIG. 13.

A seal 68 is positioned in the upper portion of the heat exchanger below the line 6, to prevent gas from flowing from the line 4 directly to the line 6. The seal 68 is suspended from the tube sheet 65 via rods 70. As shown in FIG. 13, the seal 68 is formed of a sheet metal band 100 which follows the outer contour of the subassemblies 27′, a sheet metal plate 101 and a sheet metal ring 102. As shown, the sheet metal plate 101 connects the upper end of the band 100 to a mid point of the ring 102 and the ring 102 is disposed against the steel sheel 22. The thus formed sheet metal element is suspended from the rods 70 via suitable plates 103. As shown, the outer flanges 47' of the sub-assemblies 27' are at the level of the band 100 and thus form a seal against the media flowing around the sub-assemblies 27'. A suitable means 69 is also provided in the lower zone of the heat exchanger for bracing the heat exchanger and the sub-assemblies laterally. As shown in FIGS. 13 and 14, this latter means 69 includes a sheet metal element constructed in the same manner as the seal 68 and suspended by rods 70' from the seal 68. For this purpose, suitable plates 104 are secured to the seal 68 and the brace 69. In addition, sheet metal plates 105 are disposed on the outside of the guide tubes 46' at the level of the band 100'. These plates 105 abut against each other as well against the band 100' but do not extend over the entire circumference of a sub-assembly 27'. Also, a closable inspection stub 72 is provided.

In operation, the gas coming from the gas turbine 3 flows via the line 4 into the cavity 21 at the bottom and flows over the tubes 42 of the sub-assemblies 27' within the guide tubes 46'. The gas flows into the line 6 at the upper end of the guide tubes 46' through the exit openings 48. The gas coming from the compressor 9 passes via the line 12 into the space above the tube sheet 65 and flows into the tubes 42 of the heat exchanger via the connecting lines 56'. Subsequently, the gas passes via the lower connecting lines 63 into the plenum 62 to flow upward into the line 13 via the elbow 64 and back to the reactor 1.

Instead of staggering the sub-assemblies 27' in pyramid-fashion, the sub-assemblies 27' can be arranged in two planes of different height so that a mutually staggered arrangement is obtained.

What is claimed is:

1. A heat exchanger comprising a plurality of sub-assemblies, each sub-assembly including a plurality of straight tubes; a pair of tube sheets mounting said tubes therein, each tube sheet being disposed at a respective end of said straight tubes; a pair of spherical shells, each said shell extending over a respective tube sheet; an inlet line connected to one of said shells to deliver a flowable medium into said shell for passage through said straight tubes; an outlet line connected to the other of said shells to exhaust the medium from said straight tubes; a guide tube surrounding said straight tubes and having openings at opposite ends for conducting a flowable medium therethrough over said straight tubes; and an outer flange on said guide tube intermediate said opposite ends, said flanges of said sub-assemblies being disposed adjacent to each other to form a seal preventing a flow of the flowable medium from passing about each said guide tube between said ends thereof;

a common plate having said flange of each sub-assembly supported thereon to suspend each subassembly on a vertical axis, said plate having a plurality of openings for each sub-assembly of a size corresponding to the dimensions of a respective guide tube;

a common tubular wall about said sub-assemblies and secured to said common plate, said tubular wall having openings on one side of said common plate communicating with said openings of said guide tube of each sub-assembly on said side; and a shell secured in seal-tight manner to said tubular wall at said side to form an annular space for a flow of medium passing from said sub-assemblies through said openings of said side.

2. A heat exchanger as set forth in claim 1 wherein each guide tube is secured at one end to one of said shells of a respective sub-assembly and is spaced at the opposite end from the other of said shells of said sub-assembly.

3. A heat exchanger as set forth in claim 1 wherein one of said inlet and outlet lines of a sub-assembly extends along said guide tube and passes through said flange.

4. A heat exchanger as set forth in claim 3 which further cmprises a common plate having said flange of each sub-assembly supported thereon to suspend each sub-assembly on a vertical axis, said plate having a plurality of openings of oval shape for passage of a guide tube and said one line therethrough.

5. A heat exchanger as set forth in claim 4 which further comprises an expandable sealing means between said flange and said one line to permit relative longitudinal displacement.

6. A heat exchanger comprising a plurality of sub-assemblies, each sub-assembly including a plurality of straight tubes; a pair of tube sheets mounting said tubes therein, each tube sheet being disposed at a respective end of said straight tubes; a pair of spherical shells, each said shell extending over a respective tube sheet; an inlet line connected to one of said shells to deliver a flowable medium into said shell for passage through said straight tubes; an outlet line connected to the other of said shells to exhaust the medium from said straight tubes; a guide tube surrounding said straight tubes and having openings at opposite ends for conducting a flowable medium therethrough over said straight tubes; one of said inlet and outlet lines extending along said guide tube and passing through said flange; and an outer flange on said guide tube intermediate said opposite ends, said flanges of said sub-assemblies being disposed adjacent to each other to form a seal preventing a flow of the flowable medium from passing about each said guide tube between said ends thereof; and a common plate having said flange of each sub-assembly supported thereon to suspend each sub-assembly on a vertical axis, said plate having a plurality of openings of oval shape for passage of a guide tube and said one line therethrough.

7. A heat exchanger as set forth in claim 6 which further comprises an expandable sealing means between said flange and said one line to permit relative longitudinal displacement.

* * * * *

UNITED STATES PATENT AND TRADEMARK OFFICE

CERTIFICATE OF CORRECTION

PATENT NO. : 4,147,208
DATED : April 3, 1979
INVENTOR(S) : Roland Naegelin

It is certified that error appears in the above-identified patent and that said Letters Patent are hereby corrected as shown below:

Column 2, line 54, change "XIII - XIII" to --XII-XII--

Column 6, line 22, change "cmprises" to --comprises--

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*